US006524060B2

(12) United States Patent
Conrad et al.

(10) Patent No.: US 6,524,060 B2
(45) Date of Patent: Feb. 25, 2003

(54) GAS FRICTION PUMP

(75) Inventors: Armin Conrad, Herborn (DE); Heinrich Lotz, Wetzlar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/792,454

(22) Filed: Feb. 23, 2001

(65) Prior Publication Data

US 2001/0018018 A1 Aug. 30, 2001

(30) Foreign Application Priority Data

Feb. 24, 2000 (DE) ..... 100 08 691

(51) Int. Cl.[7] ..... F01D 1/36
(52) U.S. Cl. ..... 415/90; 415/143; 417/423.4
(58) Field of Search ..... 415/90, 143; 417/423.4

(56) References Cited

U.S. PATENT DOCUMENTS 3,969,039 A * 7/1976 Shoulders ..... 250/311
4,830,584 A * 5/1989 Mohn ..... 415/143
5,611,660 A * 3/1997 Wong et al. ..... 415/90
5,664,935 A * 9/1997 Nishiuchi et al. ..... 415/143
6,106,223 A * 8/2000 Leyshon ..... 415/116
6,193,461 B1 * 2/2001 Hablanian ..... 415/90

* cited by examiner

*Primary Examiner*—Edward K. Look
*Assistant Examiner*—Igor Kershteyn
(74) *Attorney, Agent, or Firm*—Sidley Austin Brown & Wood, LLP

(57) ABSTRACT

A gas friction pump including a housing having a suction opening and an exhaust opening, main rotor and stator components arranged in the housing and cooperating with each other for delivering gases and for producing a pressure difference, and an auxiliary pumping unit provided at a side of the suction opening and having a gas delivery structure that provides for gas delivery in a radial direction, with the auxiliary pumping unit being formed of at least one stage and having auxiliary rotor and stator components, with the auxiliary rotor components being supported on the shaft which supports the main rotor components.

5 Claims, 7 Drawing Sheets

Schnitt A-A

GAS FRICTION PUMP

BACKGROUND OF THE INVENTION

1. Field of the Invention

The present invention relates to a gas friction pump including a housing having a suction opening and an exhaust opening, main rotor and stator components arranged in the housing and cooperating with each other for delivering gases and for producing a pressure difference, and a shaft arranged in the housing for supporting the main rotor components.

2. Description of the Prior Art

It is known to deliver gases with gas friction pump of different types. Their operation is based on transmission of pulses of movable wall to gas particles. In this way gas flow in a desired direction is obtained. Gas friction pumps, which operate in a pressure region in which the mean free displacement path of gas molecules is large in comparison with geometrical dimensions of the pump, i.e., which operate in a molecular flow region, are called molecular pump.

The first gas friction pumps of this type were conceived by Gaede (w. Gaede, Ann. Phys. 41 (1913), 337). The gas friction pumps were subsequently modified, with retention of the basic principle of these pumps, by Siegbahn (M. Siegbahn, Arch. Math. Astr. Fys. 30B (1943), Holweck (F. Holweck, Comptes Reduc. Acad. Science 177, 1923, p. 43) and Becker (W. Becker, Vacuum Technik (Vacuum Technology) Sep. 10, 1966). The pump, which is modified by Becker, is known as turbomolecular pump. The turbomolecular pumps found wide application in industry and science. Therefore, they would be used as an example for purposes of explanation of the present invention.

Below the drawbacks of conventional turbomolecular pumps will be described, together with explanation how the present invention permits to eliminate these drawbacks. It is to be noted that the present invention can be used not only in turbomolecular pumps but also in other types of gas friction pumps.

The suction capacity of a turbomolecular pump essentially depends on the inlet cross-section of the suction flange, mean circumferential speed of the rotor vane rim and the structure of the rotor vane adjacent to the pumping-out chamber. In addition, the suction capacity depends on the inner structure of the pump, on the gradation of pressure ratio and suction capacity between separate stages, and last but not least, on those portion of the pump or combination of pumps which is discharged against the atmospheric pressure.

The above-discussed parameters can be so optimized and the rotational speed can be so increase, within the frame of technical possibilities, that the largest portion of molecules, which are found on the rotor vane rim, e.g., can be pumped out. However, those molecules do not contain all of the molecules which are found on the inlet cross-section of the suction flange. A large portion of this cross-sectional surface is formed by the rotor end surface that does not have a gas delivery structure. Even when the rotor vane rim is increased, at the costs of reducing the rotor end surface, the suction capacity is still limited by the cross-section of the suction flange. The amount of pumped-out molecules cannot be larger than the amount of molecules to be found on the gas delivery structure of the inlet stage.

Accordingly, an object of the invention is to provide a gas friction pump having a noticeably increased suction capacity in comparison with conventional gas friction pumps at the same cross-section of the suction flange.

SUMMARY OF THE INVENTION

This and other objects of the present invention, which will become apparent hereinafter are achieved by providing an auxiliary pumping unit provided at a side of the suction opening and having a gas delivery structure that provides for gas delivery in a radial direction, with the auxiliary pumping unit being formed of at least one stage and having auxiliary rotor and stator components, with the auxiliary rotor components being supported on the shaft which supports the main rotor components.

Advantageously, the auxiliary pumping unit, which can be formed of one or several stages, has a gas delivery structure such that in addition to the gas delivery in the axial direction, gas delivery in the radial direction is provided for. With this auxiliary pumping unit, the suction capacity of the pump is not limited any more by the cross-section of the suction flange. The entire gas delivery structure, on which the gas molecules accumulate, is increased, as a result of providing of the auxiliary pumping unit. Moreover, this surface is further provided with a radial gas delivery component.

The biggest effect of providing an auxiliary pumping unit is achieved when the auxiliary pumping unit is arranged completely or partially above the pump housing. However, for constructional reasons, it may be necessary to arranged the auxiliary pumping unit completely or partially inside the pump housing. Even when the auxiliary pumping unit is arranged entirely in the pump housing, certain advantages are achieved, in comparison with the conventional gas friction pumps, as a result of the auxiliary pumping unit being provided with radial gas delivery components.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
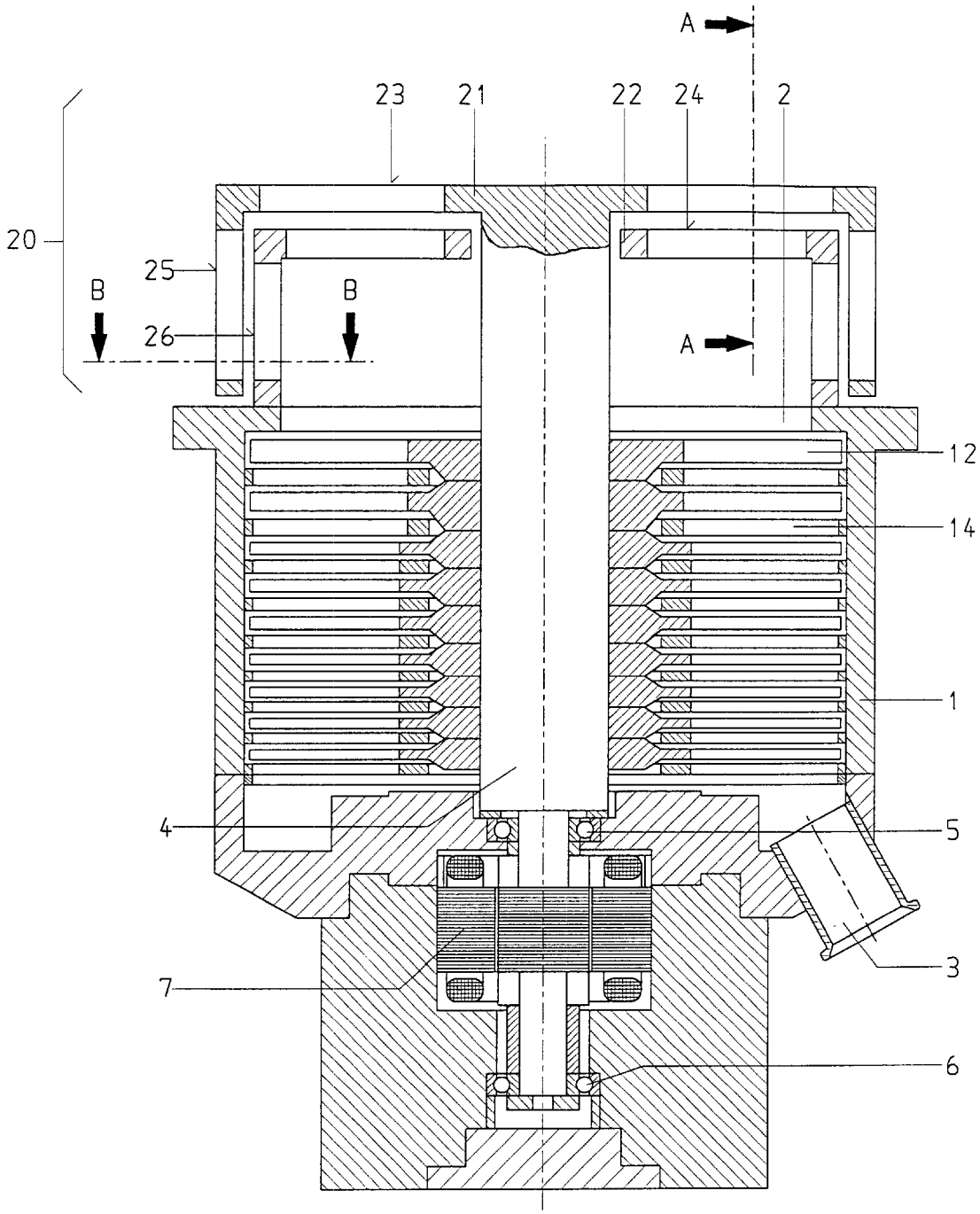
FIG. 1 a cross-sectional view of a first embodiment of a gas friction pump according to the present invention.
Figure 1A:
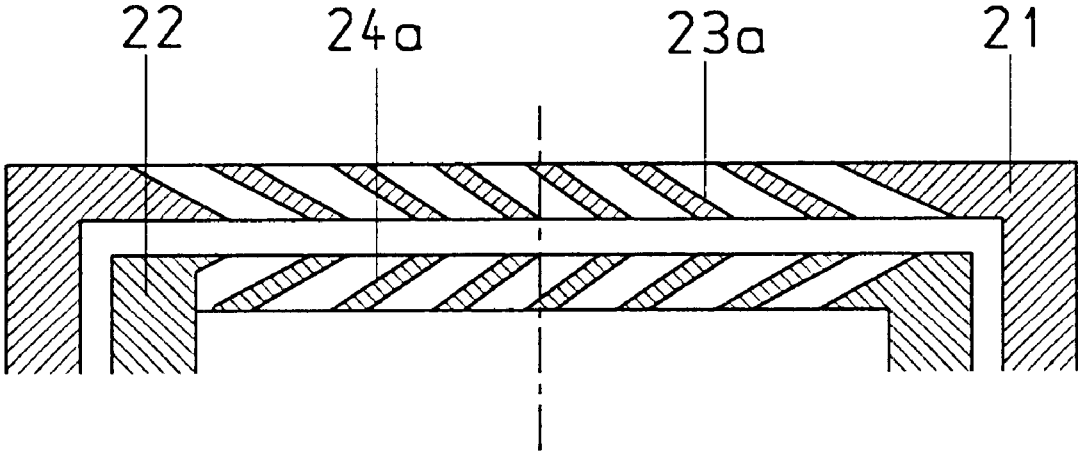
FIG. 1*a* a cross sectional view along line A—A in FIG. 1 through the end-side disc-shaped active pumping surfaces.
Figure 1B:
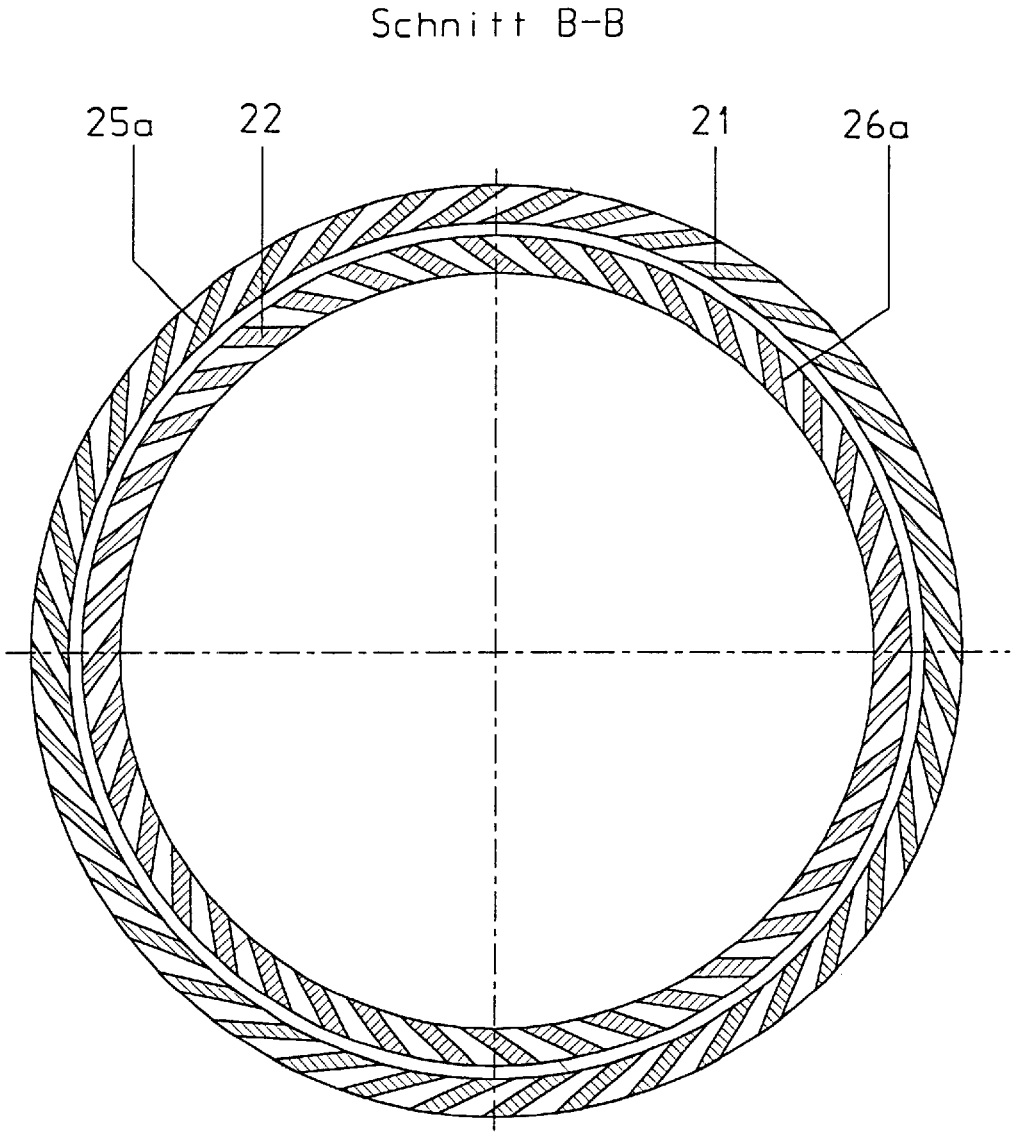
FIG. 1*b* a cross-sectional view along line B—B in FIG. 1 through the cylindrical active pumping surfaces.
Figure 1C:
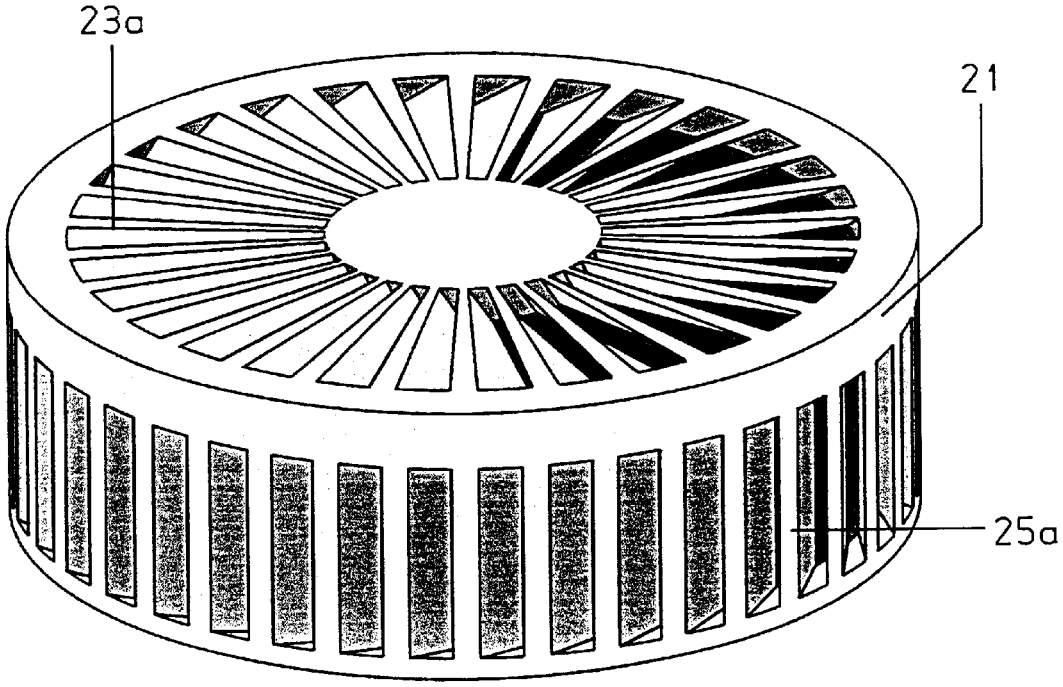
FIG. 1*c* a perspective view of a rotor component of the auxiliary pumping unit.

FIG. 1 shows a first embodiment of a gas friction pump according to the present invention and including a housing 1 having an inlet or suction opening 2 and an outlet or gas exhaust opening 3. The pump further includes a rotor shaft 4 which is supported in bearings 5 and 6 and is driven by a motor 7. Rotor discs 12 are supported on the rotor shaft 4.

The rotor discs 12 are provided with an active pumping structure and cooperate with stator discs 14, which likewise provided with an active pumping structure. The rotor discs 12 and the stator discs 14 together produce a pumping effect.

According to the present invention, a pumping unit 20 is provided at the side of the suction opening 2. In the embodiment shown in FIG. 1, the pumping unit 20 consists of a single stage. The rotor components 21 and the stator components 22 of the auxiliary pumping unit 20 consist, respectively, of endside disc-shaped sections 23, 24 and cylindrical sections 25, 26. The active pumping structure 23*a*, 24*a* of the end-side disc-shaped sections 23, 24 imitate the structure of the corresponding components of the turbomolecular pump proper. The active pumping structure 25*a*, 26*a* corresponds to those of the vane wheels.

Figure 2:
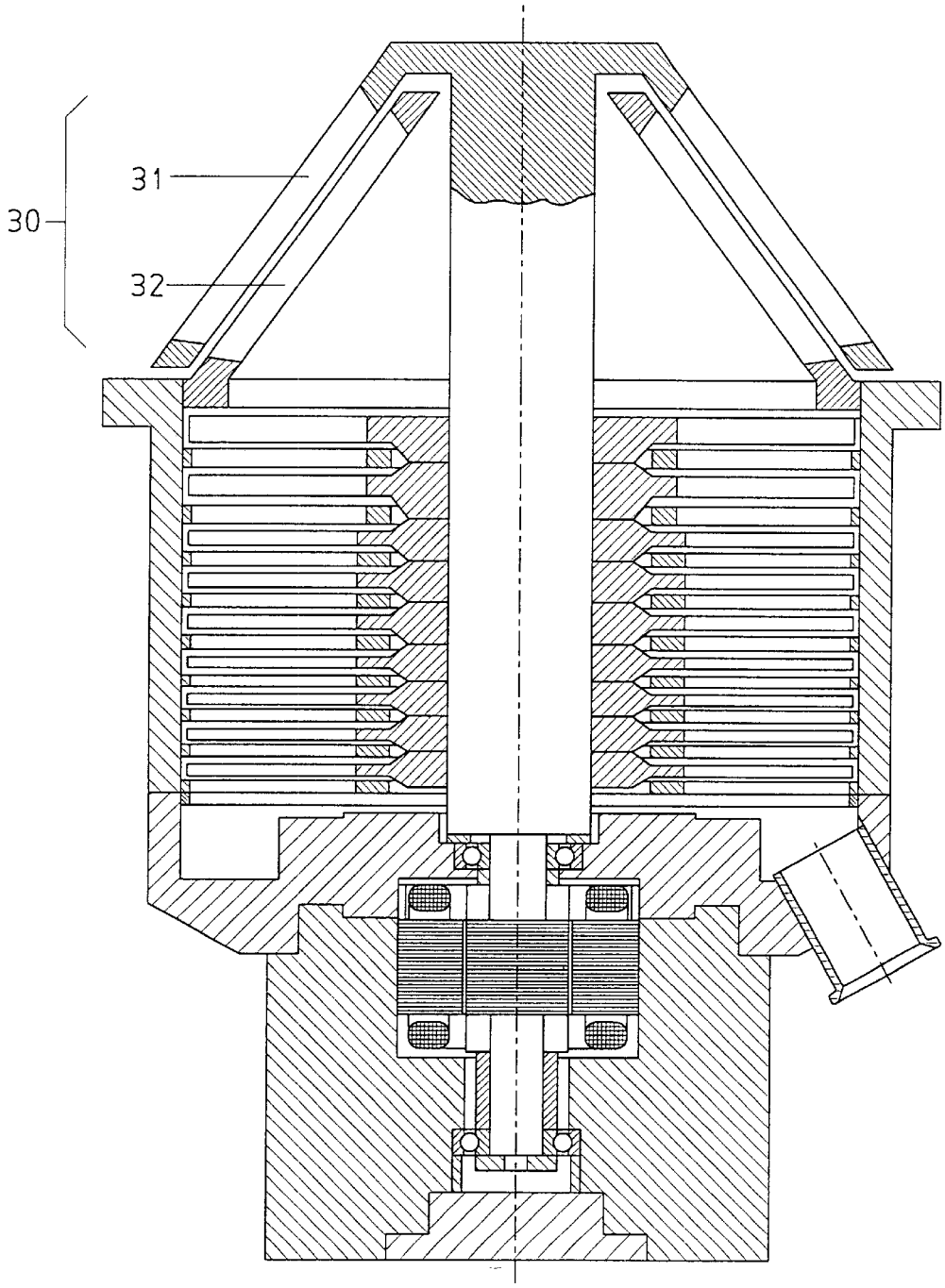
FIG. 2 a cross-sectional view of a second embodiment of a gas friction pump according to the present invention.

In the embodiment of a gas friction pump according to the present invention, which is shown in FIG. 2, the rotor components 31 and the stator components 32 of the auxiliary pumping unit 30 have a shape of a cone. The active pumping structure of these components corresponds to the profile of a vane inclined in the delivery direction.

Figure 3:
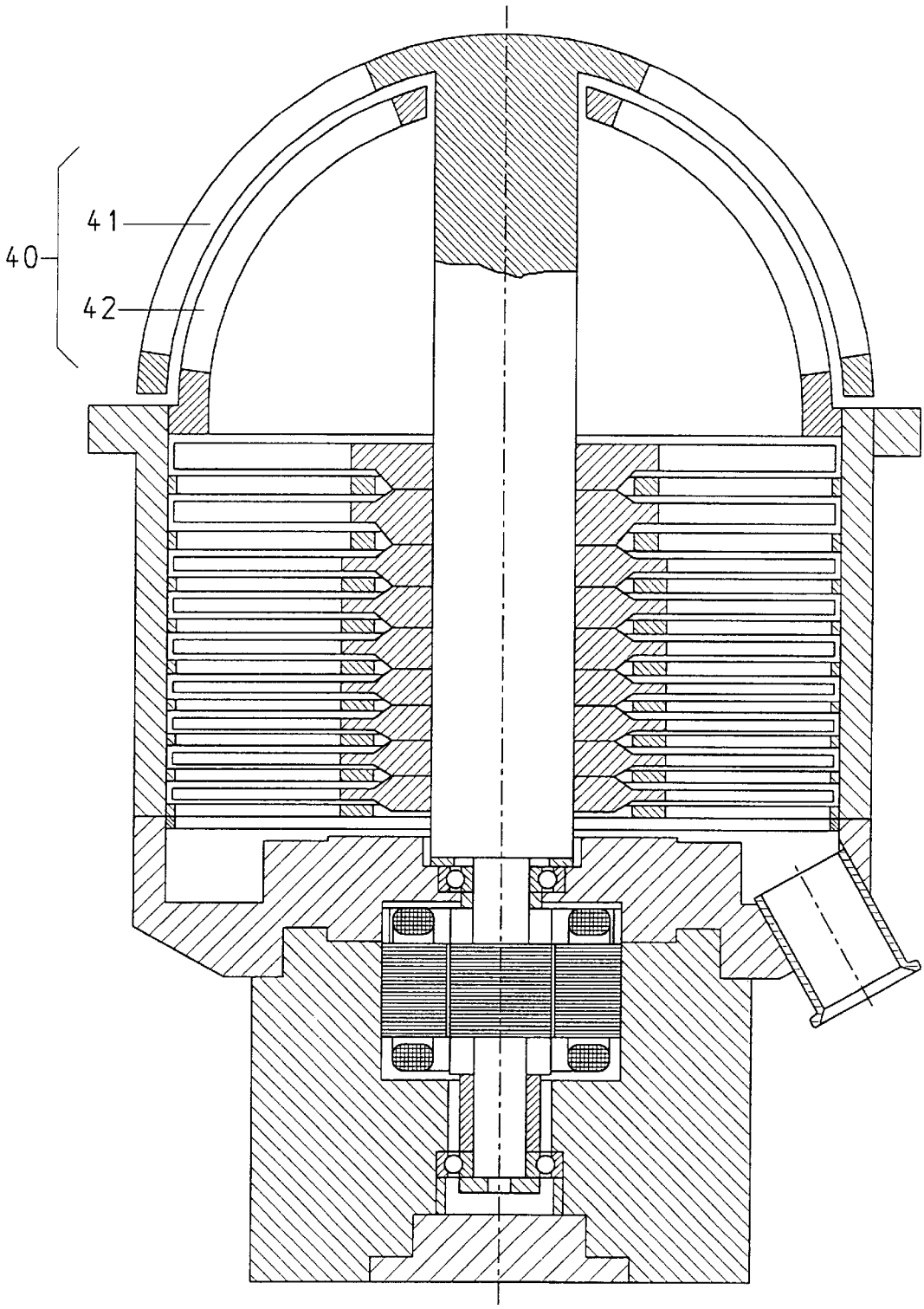
FIG. 3 a cross-sectional view of a third embodiment of a gas friction pump according to the present invention.

In the embodiment of gas friction pump according to the present invention which is shown in FIG. 3, the rotor components 41 and the stator components 42 of the auxiliary pumping unit 40 are dome-shaped. The active pumping structure of these components likewise corresponds to the vane profile inclined in the delivery direction.

Figure 4:
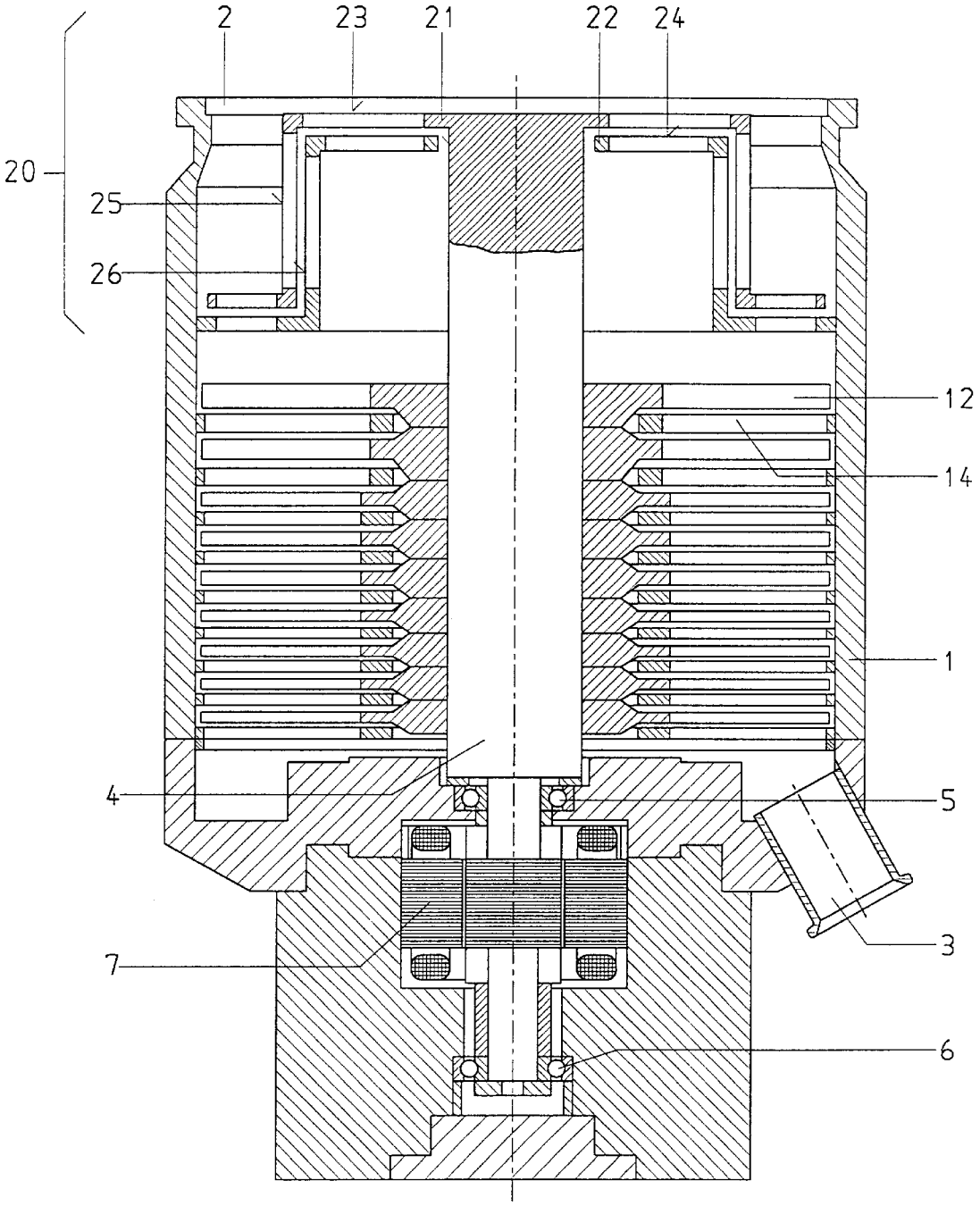
FIG. 4 a cross-sectional view of a fourth embodiment of a gas friction pump according to the present invention.

In the embodiment of the gas friction pump according to the present invention shown in FIG. 4, the auxiliary pumping unit 20 is arranged within the housing 1. In this embodiment, the auxiliary pumping unit 20 is similar to the auxiliary pumping unit 20 shown in FIG. 1. The auxiliary pumping units 30 and 40, which are shown in FIGS. 2–3, can likewise be arranged within the housing of the turbomolecular pump proper.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A gas friction pump, comprising a housing having a suction opening and an exhaust opening; main rotor and stator components arranged in the housing and cooperating with each other for delivering gases and for producing a pressure difference; a shaft arranged in the housing for supporting the main rotor components; and an auxiliary pumping unit provided at a side of the suction opening outside of the housing and having a gas delivery structure that provides for gas delivery in a radial direction, the auxiliary pumping unit being formed of at least one stage and having auxiliary rotor and stator components, with the auxiliary rotor components being supported on the shaft which supports the main rotor components, wherein the auxiliary rotor components and stator components of the auxiliary pumping unit have a conical shape.

2. A gas friction pump as set forth in claim 1, wherein the auxiliary pumping unit has a gas delivery structure that insures gas delivery also in an axial direction.

3. A gas friction pump, comprising a housing having a suction opening and an exhaust opening; main rotor and stator components arranged in the housing and cooperating with each other for delivering gases and for producing a pressure difference; a shaft arranged in the housing for supporting the main rotor components; and an auxiliary pumping unit provided at a side of the suction opening and having a gas delivery structure that provides for gas delivery in a radial direction, the auxiliary pumping unit being formed of at least one stage and having auxiliary rotor and stator components, with the auxiliary rotor components being supported on the shaft which supports the main rotor components, wherein the auxiliary rotor components and the auxiliary stator components of the auxiliary pumping unit are formed each of an end-side disc-shaped active pumping section and a cylindrical active pumping section.

4. A gas friction pump, comprising a housing having a suction opening and an exhaust opening; main rotor and stator components arranged in the housing and cooperating with each other for delivering gases and for producing a pressure difference; a shaft arranged in the housing for supporting the main rotor components; and an auxiliary pumping unit provided at a side of the suction opening and having a gas delivery structure that provides for gas delivery in a radial direction, the auxiliary pumping unit being formed of at least one stage and having auxiliary rotor and stator components, with the auxiliary rotor components being supported on the shaft which supports the main rotor components, wherein the auxiliary rotor components and stator components of the auxiliary pumping unit have a conical shape.

5. A gas friction pump, comprising a housing having a suction opening and an exhaust opening; main rotor and stator components arranged in the housing and cooperating with each other for delivering gases and for producing a pressure difference; a shaft arranged in the housing for supporting the main rotor components; and an auxiliary pumping unit provided at a side of the suction opening and having a gas delivery structure that provides for gas delivery in a radial direction, the auxiliary pumping unit being formed of at least one stage and having auxiliary rotor and stator components, with the auxiliary rotor components being supported on the shaft which supports the main rotor components, wherein the auxiliary rotor components and stator components of the auxiliary pumping unit have a dome shape.

* * * * *